US006375010B1

(12) United States Patent
Thibault

(10) Patent No.: US 6,375,010 B1
(45) Date of Patent: Apr. 23, 2002

(54) ONE-PIECE FOLDING CARTON WITH HINGED DISPLAY HANG TAB AND METHOD FOR MAKING SAME

(75) Inventor: Richard C. Thibault, Bromall, PA (US)

(73) Assignee: Impac Group, Inc., New York, NY (US)

( * ) Notice: Subject to any disclaimer, the term of this patent is extended or adjusted under 35 U.S.C. 154(b) by 0 days.

(21) Appl. No.: 09/620,449

(22) Filed: Jul. 20, 2000

(51) Int. Cl.[7] ..... B65D 5/50
(52) U.S. Cl. ..... 206/762; 206/806
(58) Field of Search ..... 206/762, 806, 206/581, 562.3; 229/117.18, 162

(56) References Cited

U.S. PATENT DOCUMENTS 3,074,614 A 1/1963 Moffat
3,587,837 A * 6/1971 Smith ..... 229/117.18
4,020,947 A 5/1977 Roccaforte
4,279,376 A 7/1981 Roccaforte
4,421,267 A * 12/1983 Wischoff ..... 229/117.18
4,457,431 A 7/1984 Lundquist et al.
5,458,233 A 10/1995 Herrin
5,842,632 A * 12/1998 Van Hest ..... 229/153
5,878,948 A * 3/1999 Schultz et al. ..... 229/148
6,209,292 B1 * 4/2001 Krahn ..... 53/458

* cited by examiner

*Primary Examiner*—Shian Luong
(74) *Attorney, Agent, or Firm*—Priest & Goldstein, PLLC

(57) ABSTRACT

A one-piece folding carton is described that has a hang tab pivotably mounted behind a first carton panel, the hang tab being pivotable between a tucked position in which the hang tab is tucked behind the first carton panel, and an extended position in which an upper portion of the hang tab extends out of the carton for hanging the carton on a display. The carton further includes a first restraining surface positioned with respect to the hang tab such that the hang tab is prevented from being pulled all the way out of the carton by an outside edge of the hang tab butting up against the first restraining surface when the hang tab is in its extended position.

17 Claims, 5 Drawing Sheets

ONE-PIECE FOLDING CARTON WITH HINGED DISPLAY HANG TAB AND METHOD FOR MAKING SAME

BACKGROUND OF THE INVENTION

1. Field of the Invention

The present invention relates generally to improvements in folding cartons, and particularly to advantageous aspects of a folding carton having a hinged display hang tab.

2. Description of the Prior Art

Certain retail goods, such as cosmetics, are packaged in small cartons that are typically displayed either in a counter display or in a hang display. In a counter display, the cartons are stacked on a flat surface, one on top of another. In a hang display, the cartons are hung on posts extending horizontally outward from a pegboard or other display structure. In a hang display, the upper portion of each carton is typically provided with a tab or flap having a hole or slot that slides over the post.

The choice of display mode is governed by two major considerations: the attractiveness of the display, and the efficient use of retail space. A counter display is typically more attractive than a hang display and is therefore chosen for higher-end products. Further, a hang tab or flap on a carton can be unsightly and interfere with the esthetic design of the carton. However, a counter display typically does not use retail space as efficiently as a hang display, in which several different items can be spaced closely together in both a vertical and a horizontal direction.

It may be desirable for a number of reasons to use a counter display for a particular product in one retail setting, but to use a hang display for the same product in a different retail setting. It is desirable for reasons of economy and efficiency to use the same carton for both a counter display and a hang display. However, because of esthetic considerations and in order to facilitate stacking of the cartons, it is desirable for the hang tab to be hidden from view in a counter display and yet easily accessible for use in a hang display. Further, it desirable for such a hang tab to be manufactured as economically as possible.

SUMMARY OF THE INVENTION

One aspect of the invention provides a one-piece folding carton having a hang tab pivotably mounted behind a first carton panel, the hang tab being pivotable between a tucked position in which the hang tab is tucked behind the carton panel, and an extended position in which an upper portion of the hang tab extends out of the carton for hanging the carton on a display. The carton further includes a first restraining surface positioned with respect to the hang tab such that the hang tab is prevented from being pulled all the way out of the carton by an outside edge of the hang tab butting up against the first restraining surface when the hang tab is in its extended position.

Additional features and advantages of the present invention will become apparent by reference to the following detailed description and accompanying drawings.

DETAILED DESCRIPTION

Figure 1A:
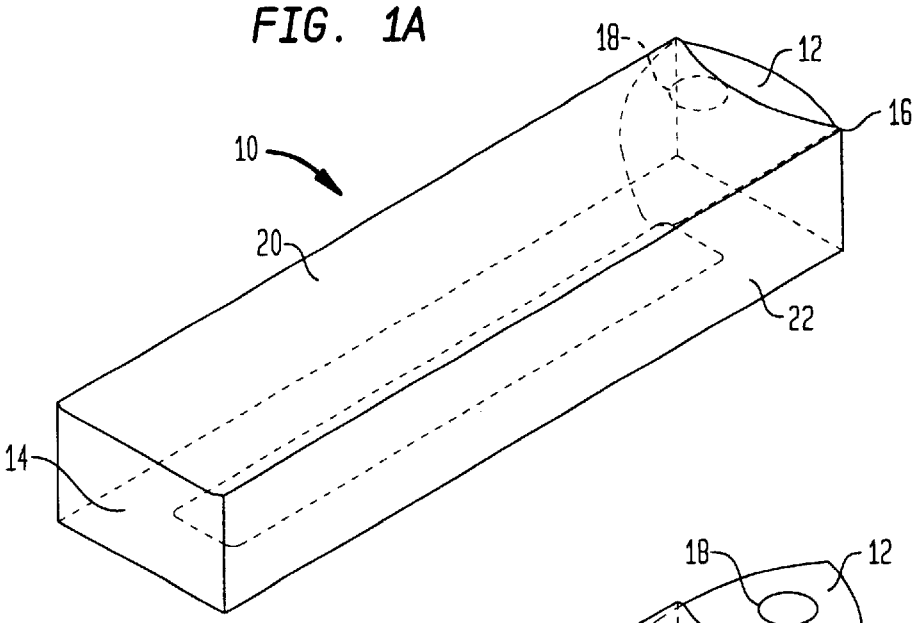
FIG. 1A shows a rear perspective view of a carton with a hinged hang tab according to a first embodiment of the present invention, with the hang tab in its initial, tucked position behind a rear carton panel.
Figure 1B:
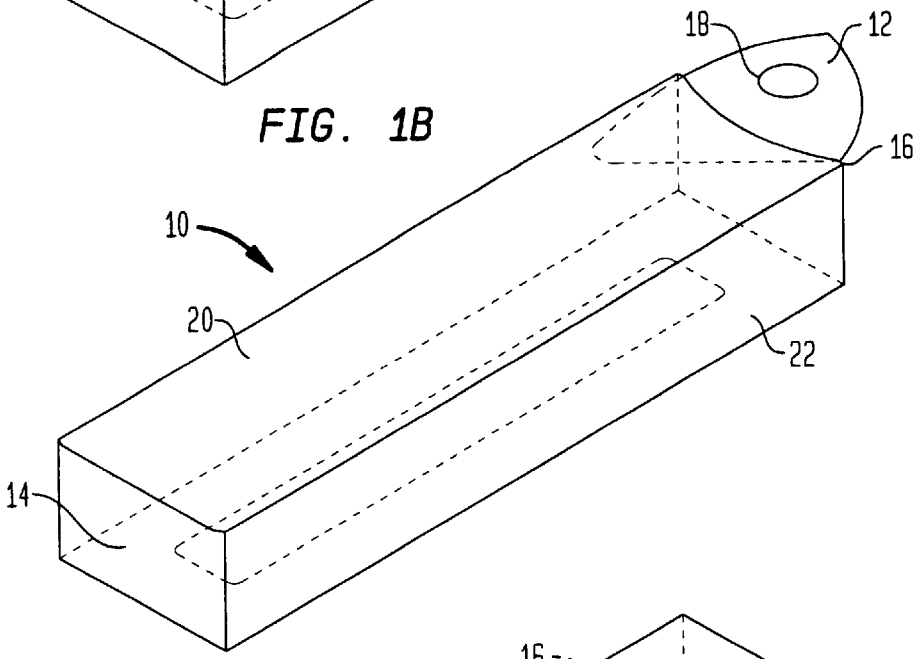
FIG. 1B shows a rear perspective view of the carton shown in FIG. 1A with the hang tab partially extended out from behind the rear carton panel.
Figure 1C:
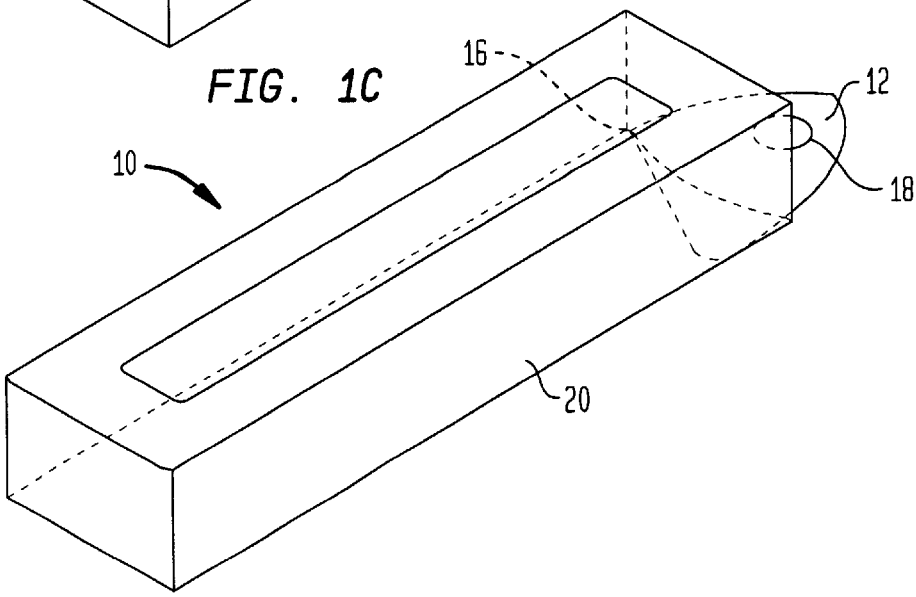
FIG. 1C shows a front perspective view of the carton shown in FIGS. 1A and 1B with the hang tab in its fully extended position.

FIGS. 1A and 1B show rear perspective views, and FIG. 1*c* shows a front perspective view, of a first embodiment of a folding carton 10 according to the present invention. The carton 10 includes a hang tab 12 that, in FIG. 1A, is tucked behind the rear panel 14 of the carton 10, with a small portion of the hang tab 12 protruding out from behind the rear panel 14 for easy access by a store employee. As described in further detail below, the hang 12 pivots around a hinge 16 at one comer of the hang tab. In FIG. 1B, the hang tab 12 has been pivoted partially out from behind the rear panel 14, exposing an eye 18 that is dimensioned to fit over a post in a hang display. FIG. 1C shows a front perspective view of the hang 12 after it has been pivoted into its fully extended position. The hang tab 12 pivots freely between its tucked and extended positions. As described in detail below in connection with FIGS. 4A and 4B, the hang tab 12 is shaped and positioned with respect to the carton's side panels 20 and 22 such that the hang tab 12 is prevented from being moved beyond its tucked and extended positions by edges of the hang tab 12 butting up against the interior surfaces of the side panels 20 and 22.

Figure 2A:
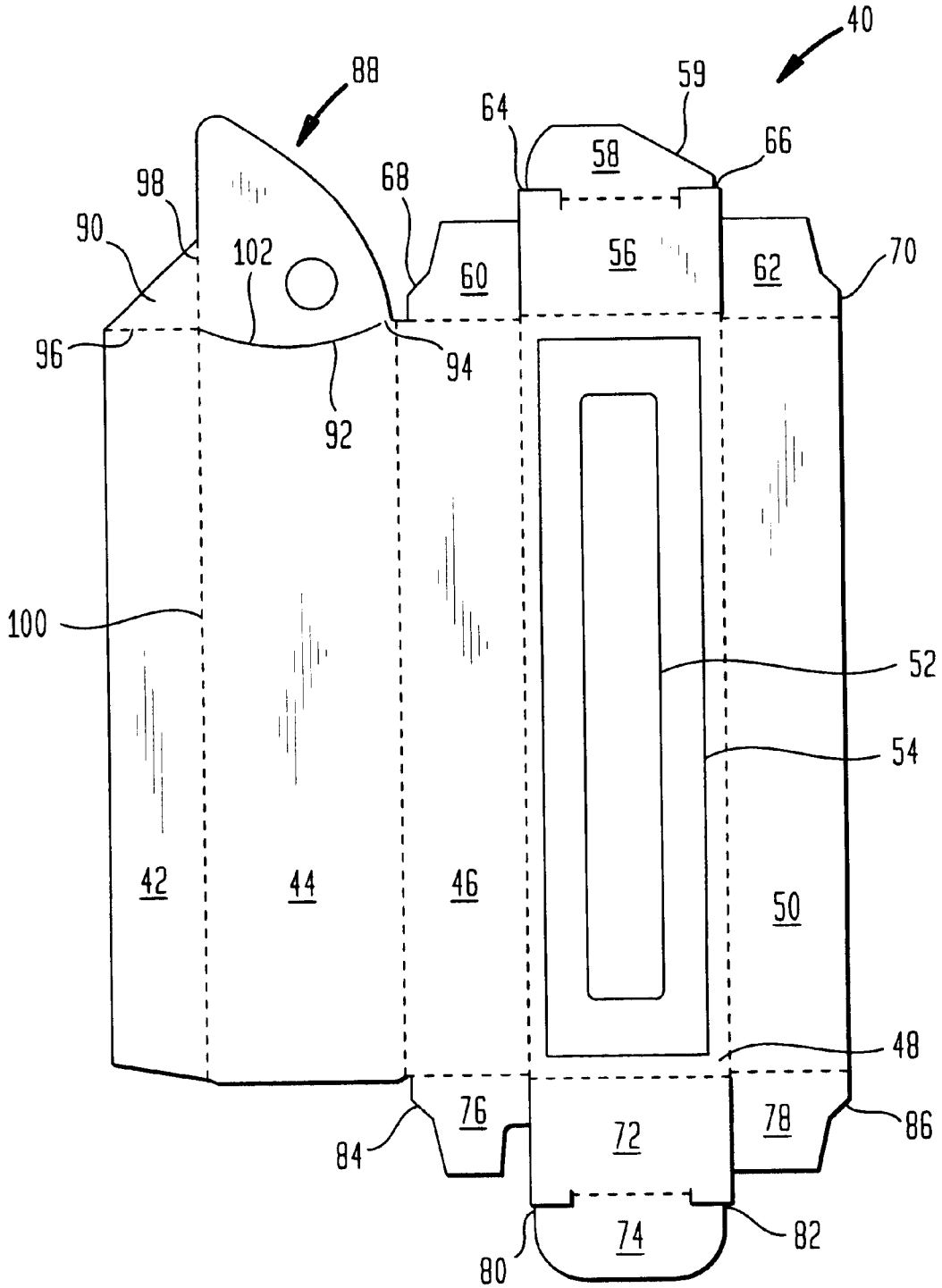
FIG. 2A shows a plan view of a carton blank that can be fabricated into the carton shown in FIGS. 1A through 1C.

In the present embodiment of the invention, the carton 10 shown in FIGS. 1A and 1B is fabricated from a sheet of cardboard that is cut and scored to form a blank that is then folded and glued, as described below. Other suitable materials that can be used to fabricate the carton include paperboard, corrugated or fluted board, plastic, etc. FIG. 2A shows a plan view of a carton blank 40 according to the present invention. When the blank 40 is fabricated from cardboard, the blank typically includes a glossy, coated side forming the exterior surfaces of the finished carton and a matte, uncoated side forming the interior surfaces of the finished carton. The exterior surface of the blank typically includes a graphic design, as well as printed text identifying the produce and its ingredients. Although it would be theoretically possible to use cardboard having two glossy, coated sides, this adds to the cost of the carton. In FIG. 2A, the blank 40 is shown from its uncoated, interior side.

As shown in FIG. 2A, the blank 40 includes the following components: a rear panel 44, a glue flap panel 42 adjacent to the rear panel 44, a right side panel 46 adjacent to the rear panel 44 opposite the glue flap panel 42, a front panel 48, and a left side panel 50. In the present embodiment of the invention, the front panel 48 includes a window 52 cut therein to allow the contents of the finished carton to be displayed so that they can be seen by a potential customer without opening the carton. In addition, a clear sheet 54 fabricated from mylar or other suitable material, is glued over the window 52.

The top side of the blank 40 includes a top panel 56 and tuck 58 extending upward from the front panel 48, and a pair of dust flaps 60 and 62 extending upward, respectively, from the right side and left side panel 46 and 50. A pair of slit lock 65 and 66 are cut between the top panel 56 and tuck 58. These locks engage a pair of shoulders 68 and 70 on the dust flaps 60 and 62. The top panel tuck 58 further includes a beveled section 59, which provides clearance of the hang tab support panel 90, as described further below.

The bottom side of the blank 40 includes a bottom panel 72 and tuck 74 extending down from the front panel 58, and a pair of dust flaps 76 and 78 extending downward, respectively, from the right side and left side panels 46 and 50. A pair of slit locks 80 and 82 are cut between the bottom panel 72 and the tuck 74. These locks engage a pair of shoulders 84 and 86 on the dust flaps 76 and 78.

Extending upward from the rear panel 44 is a hang tab 88, and extending upward from the glue flap panel 42 is a triangular hang tab support panel 90. It will be seen that the hang tab 88 corresponds in shape to the hang tab 12 illustrated in FIGS. 1A through 1C. There is a curved cut 92 between the rear panel 44 and the hang tab 88. The hang tab 88 is attached to the hang tab support panel 90, and is also attached to the rear panel 44 by a breakaway nick 94 on the far side of the curved cut 92. A first score line is provided at the base of the hang tab support panel 96 and a second score line 98 is provided between the hang tab 88 and the hang tab support panel 90. The second score line 98 is an extension of the score line 100 between the glue flap panel 42 and the rear panel 44. It will be seen that when the hang tab 88 and hang tab support panel 90 are folded down toward the glue flap panel 42 and rear carton panel 44 around the first score line 96, the cut 92 opens up, such that the curved section 102 of the hang tab 68 adjacent to the rear panel 44 will project upward, slightly protruding from behind the rear carton panel 44 in the finished carton.

Figure 2B:
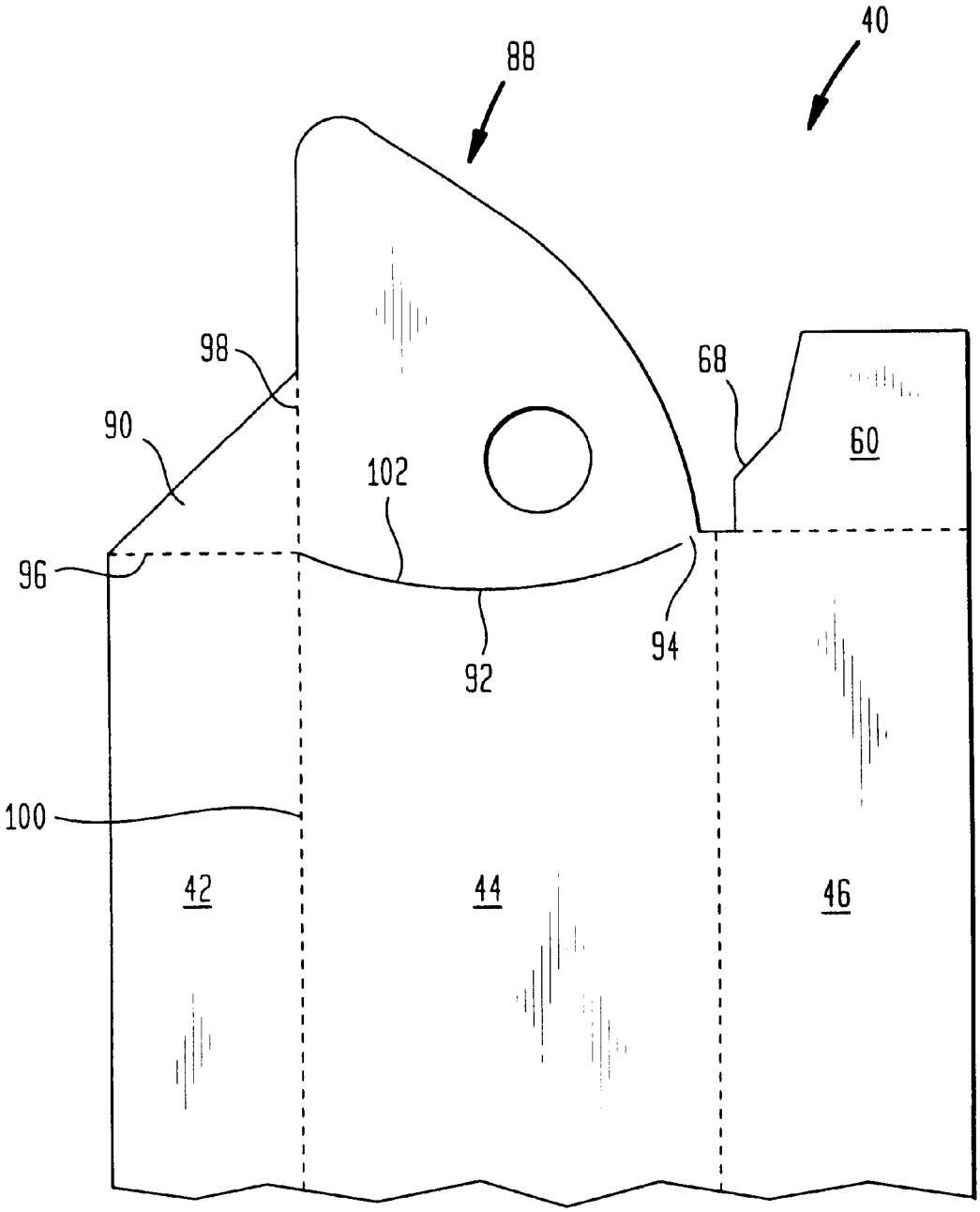
FIG. 2B shows a close up view of the hang tab portion of the carton blank shown in FIG. 2A.

FIG. 2B shows a closeup view of the hang tab portion of the carton blank 40 shown in FIG. 2A. As shown in FIG. 2B, the breakaway nick 94 is a portion of the carton blank 40 adjacent to the curved cut 92 that has not been cut all the way through. The breakaway nick 94 remains intact after the hang tab 88 and hang tab support panel 90 have been folded along score line 96 down over the rear carton panel 44 and glue flap panel 42.

Figure 3C:
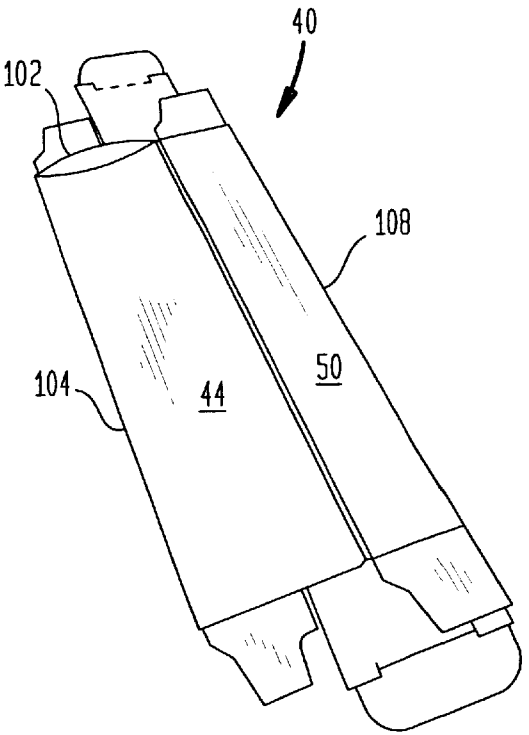
FIG. 3C shows a partial perspective view of the folded carton blank shown in FIG. 3B, with an additional fold.
Figure 3B:
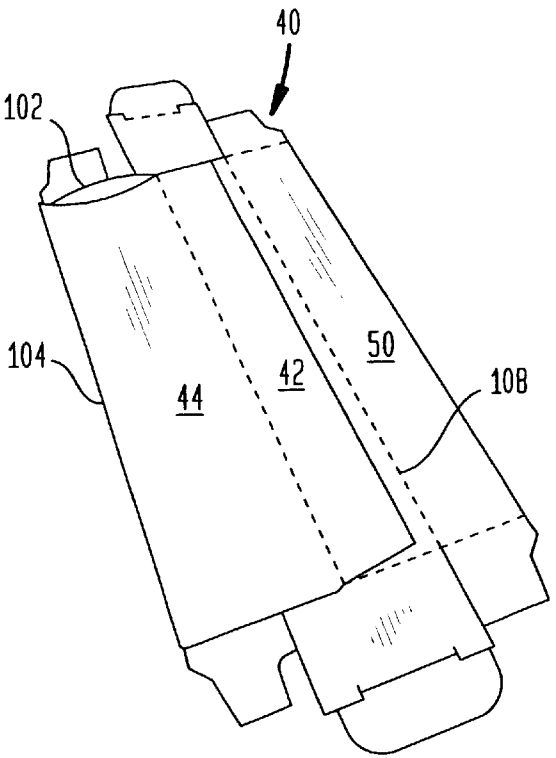
FIG. 3B shows a partial perspective view of the folded carton blank shown in FIG. 3A, with an additional fold.
Figure 3A:
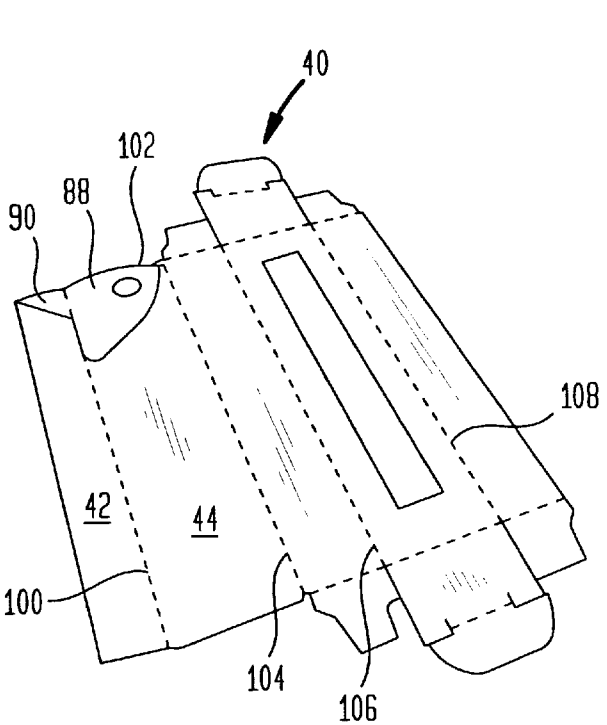
FIG. 3A shows a perspective view of the carton blank shown in FIG. 2A, partially folded during the course of fabricating a carton from the carton blank.

FIGS. 3A through 3C show sequential perspective views illustrating the construction of a carton using the blank 40 shown in FIG. 2A. As illustrated in FIG. 3A, initially the hang tab 88 and hang tab support panel 90 are folded along score line 96 down over the rear carton panel 44 and the glue flap panel 42. Then, score lines 100 and 106 are pre-broken by folding and unfolding the carton blank 40 along these score lines. As illustrated in FIG. 3B, the glue flap panel 42 and rear panel 44 are folded as a single unit along score line 104. As discussed above, a small curved edge 102 of the hang tab 88 protrudes from the upper edge of the rear panel 44, providing access to the hang tab 88 from the exterior of the finished carton. As illustrated in FIG. 3C, the left side carton panel 50 is then folded along score line 108 and glued on top of the glue flap panel 42. The carton can be shipped in the partially form shown in FIG. 3C. To assemble the carton into its finished form, the carton is opened up into a rectangular tube along score lines 100, 104, 106, and 108. The bottom dust flaps are folded across the bottom opening, and the bottom panel and tuck are folded into position over the dust flaps to close off the bottom opening. The contents of the carton are then loaded into the carton through the top opening. Then, the top dust flaps are folded across the top opening, and the top panel and tuck are folded into position over the dust flaps to close off the top opening.

Figure 4A:
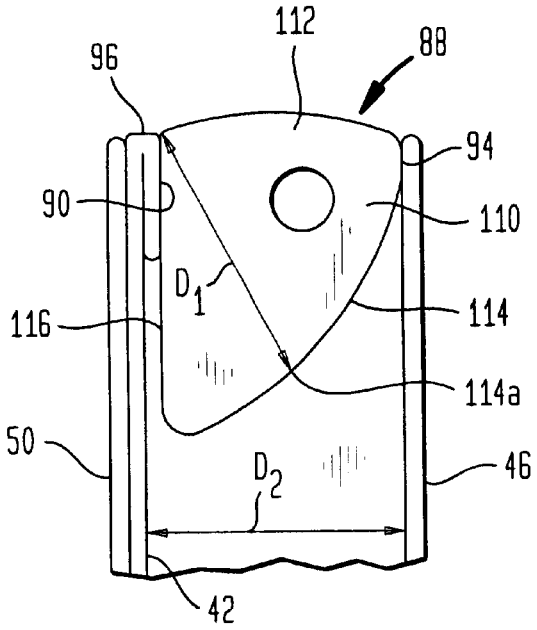
FIG. 4A shows a partial cross section view of a carton according to the present invention with the hang tab in its initial, tucked position.
Figure 4B:
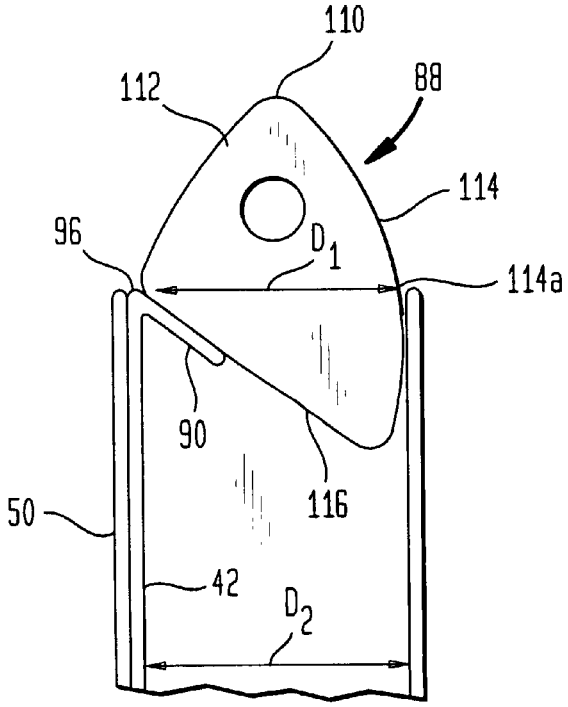
FIG. 4B shows a partial cross section view of a carton according to the present invention with the hang tab in its fully extended position.

FIGS. 4A and 4B illustrate the operation of the hang tab 88 in the finished carton. FIG. 4A shows the hang tab 88 in its initial, tucked position, and FIG. 4B shows the hang tab 88 in its fully extended position. As shown in FIG. 4A, in its initial position, the hang tab 88 is positioned between the left side carton panel 46 and the right side carton panel 50. The hang tab 88 is supported on one side by the hang tab support panel 90, which has been folded along score line 96 so that it lies on top of the glue flap panel 90, which, as described above, is glued to the right side carton panel 50. The hang tab 88 is supported on its other side by a breakaway nick 94 that attached the tip 110 of the hang tab 88 to the rear carton panel. In its initial position, a curved side edge 112 of the hang tab 88 protrudes above the carton to provide access to the hang tab 88.

FIG. 4B shows the hang tab 88 in its extended position, after it has been broken away from the rear carton panel. As shown in FIG. 4B, score line 96 functions as a hinge, allowing the hang tab 88 to pivot freely back and forth between its tucked and extended positions. According to the present embodiment of the invention, the hang tab 88 is shaped to prevent it from being pivoted beyond its tucked and extended positions. As shown in FIGS. 4A and 4B, the hang tab 88 includes an outer edge 114 opposite the hinge 96. The distance $D_1$ between the hinge 96 and the outer edge 114 is not constant along the length of the outer edge 114. Rather, distance $D_1$ varies such that when the hang tab 88 reaches its extended position in FIG. 4B, a portion of the outer edge 114 butts up against the right side panel 46, thus preventing the hang tab 88 from being pivoted beyond its extended position.

As shown in FIGS. 4A and 4B, the outer edge 114 of the hang tab 88 includes a point 114*a* that, together with the hinge 96 defines the border between the portion of the hang tab 88 that is exposed when the hang tab 88 is in its extended position, and the portion of the hang tab 88 that remains hidden behind the rear carton panel. Thus, above point 114*a*, distance $D_1$ is less than distance $D_2$, the distance between the glue flap panel 42 and the right side carton panel 46. This allows the hang tab 88 to be pivoted freely between its tucked and extended positions. Below point 114*a*, distance $D_1$ increases such that, at some point below point 114*a*, distance $D_1$ is greater than $D_2$, such that when the hang tab 88 is in its extended position, a portion of the outer edge 114 below point 114*a* butts up against the right side carton panel 46, which acts as a restraining surface. In addition, the hang tab 88 includes an inside edge 116 that butts up against the glue flap panel 42 when the hang tab 88 is pivoted into the carton beyond its initial position. Thus, the glue flap panel 42 functions as a second restraining surface, preventing the hang tab 88 from getting "lost" within the carton.

It will be appreciated that the hang tab 88 may be shaped differently without department from the spirit of the present invention. For example, in the present embodiment, the hang tab 88 has been shaped such that the exposed portion of the hang tab 88 has a pleasing, symmetrical shape, and such that the outer edge 114 of the hang tab 88 is gently curved. However, it would be possible to accomplish the desired pivoting and braking functions with other shapes. Further, it will be appreciated that although in the present embodiment, the right and left side carton panels are perpendicular to the rear carton panel, it would also be possible to use the present invention in a carton where the side panels are angled differently, such as, for example, in a triangular box.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

I claim:

1. A carton, comprising:

a hang tab pivotably mounted behind a first carton panel, the hang tab being pivotable between a tucked position in which the hang tab is tucked behind the carton panel, and an extended position in which an upper portion of the hang tab extends out of the carton for hanging the carton on a display;

the carton further including a first restraining surface positioned with respect to the hang tab such that the hang tab is prevented from being pulled all the way out of the carton by an outside edge of the hang tab butting up against the first restraining surface when the hang tab is in the extended position.

2. The carton of claim 1, wherein the first restraining surface comprises an inner surface of a second carton panel adjacent to the first carton panel.

3. The carton of claim 1, wherein when the hang tab is in the tucked position, a portion of the hang tab protrudes from behind the first carton panel, thereby providing access to the hang tab.

4. The carton of claim 1, wherein the hang tab is initially held in the tucked position by a breakaway nick attaching the hang tab to the first carton panel.

5. The carton of claim 1, wherein the hang tab further includes an inside edge that butts up against a second restraining surface when the hang tab is pivoted into the carton beyond the tucked position, thereby preventing the hang tab from being pivoted further beyond the tucked position.

6. The carton of claim 5, wherein the second restraining surface comprises an inside surface of a third carton panel adjacent to the first carton panel, opposite from the second carton panel.

7. The carton of claim 6, wherein the third carton panel is a glue flap panel that is attached to a fourth carton panel.

8. The carton of claim 6, wherein the hang tab is mounted by a hinge to the glue flap.

9. A carton blank for use in manufacturing a carton having a swinging hang tab, the carton blank comprising:

a first carton panel;

a second carton panel adjacent to the first carton panel;

a hang tab support panel extending upward from the second carton panel;

a hang tab attached to the hang tab support panel, the hang tab being positioned over the first carton panel, such that when the hang tab and the hang tab support panel are folded over the first carton panel and the second carton panel, and when the second carton panel is folded at an angle towards the first carton panel, the hang tab support panel functions as a hinge, allowing the hang tab to pivot between a tucked position behind the first carton panel and an extended position in which the hang tab extends out from behind the first carton panel.

10. The carton blank of claim 9, wherein the hang tab is attached to the first carton panel by a breakaway nick.

11. The carton blank of claim 9, wherein the carton blank includes a third carton panel adjacent to the first carton panel opposite the second carton panel, the third carton panel positioned with respect to the hang tab such that when the third carton panel is folded at an angle towards the first carton panel, the third carton panel provides a restraining surface against which an outside edge of the hang tab butts when the hang tab is in the extended position, thereby preventing the hang tab from pivoting beyond the extended position.

12. The carton blank of claim 9, wherein the hang tab has an inside edge that butts up against the second carton panel when the hang tab is pivoted into the carton beyond the tucked position, the second carton panel providing a restraining surface against which the inside edge of the hang tab butts when it is pivoted into the carton beyond the tucked position.

13. A method for manufacturing a carton, comprising the following steps:

(a) pivotably mounted a hang tab behind a first carton panel, the hang tab being pivotable between a tucked position in which the hang tab is tucked behind the carton panel, and an extended position in which an upper portion of the hang tab extends out of the carton for hanging the carton on a display;

(b) positioning a first restraining surface with respect to the hang tab such that the hang tab is prevented from being pivoted beyond the extended position by an outside edge of the hang tab butting up against the first restraining surface when the hang tab is in the extended position.

14. The method of claim 13, wherein step (a) further includes mounting the hang tab behind the first carton panel such that when the hang tab is in the tucked position, a portion of the hang tab protrudes from behind the first carton panel, thereby providing access to the hang tab.

15. The method of claim 13, further including:

(c) attaching the hang tab to the first carton panel with a breakaway nick.

16. the method of claim 13, further including:

(c) positioning a second restraining surface with respect to the hang tab such that when the hang tab is pivoted into the carton beyond the tucked position, an inside edge of the hang tab butts up against the second restraining surface, thereby preventing the hang tab from being pivoted further beyond the tucked position.

17. The method of claim 13, wherein step (a) includes pivotable mounting the hang tab to a second carton panel adjacent to the first carton panel.

* * * * *